US012320577B2

(12) United States Patent
Sarma et al.

(10) Patent No.: US 12,320,577 B2
(45) Date of Patent: Jun. 3, 2025

(54) REFRIGERATOR CABINET WITH A TRIM BREAKER AND VACUUM INSULATED PANEL ASSOCIATED WITH THE TRIM BREAKER

(71) Applicant: WHIRLPOOL CORPORATION, Benton Harbor, MI (US)

(72) Inventors: Abinash Sarma, Tinsukia (IN); Rahul Subhash Chhajed, Stevensville, MI (US); Subrata Shannigrahi, St. Joseph, MI (US); Vishal Jaywantrao Patil, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 109 days.

(21) Appl. No.: 18/112,375

(22) Filed: Feb. 21, 2023

(65) Prior Publication Data

US 2024/0280316 A1 Aug. 22, 2024

(51) Int. Cl.
*F25D 23/06* (2006.01)
*F25D 23/08* (2006.01)

(52) U.S. Cl.
CPC ..... *F25D 23/085* (2013.01); *F25D 23/062* (2013.01); *F25D 23/087* (2013.01); *F25D 2201/14* (2013.01)

(58) Field of Classification Search
CPC .... F25D 23/085; F25D 23/087; F25D 23/028; F25D 23/066; F25D 23/062; F25D 11/02; F25D 23/065; F25D 23/063; F25D 2400/04; F25D 2201/14; F16L 59/065
See application file for complete search history.

(56) References Cited

U.S. PATENT DOCUMENTS 2,613,509 A 10/1952 Philipp
5,605,047 A * 2/1997 Park ..... F25D 23/003 62/3.6
6,109,712 A * 8/2000 Haworth ..... A47L 15/4209 312/406
10,830,384 B2 11/2020 Allard et al.
2005/0235682 A1* 10/2005 Hirai ..... F25D 23/062 312/401
2012/0297813 A1* 11/2012 Hanley ..... F16L 59/065 62/331

(Continued)

FOREIGN PATENT DOCUMENTS

EP 3623731 A1 3/2020
WO 2011036872 A1 3/2011

*Primary Examiner* — Hiwot E Tefera
(74) *Attorney, Agent, or Firm* — Price Heneveld LLP

(57) ABSTRACT

A cabinet for a refrigerator includes: (a) a first inner liner defining a first cavity; (b) a second inner liner defining a second cavity; (c) an outer wrapper at least partially surrounding the first inner liner and the second inner liner; (d) a trim breaker coupling the outer wrapper, the first inner liner, and the second inner liner together, the trim breaker comprising (i) a first opening into the first cavity, (ii) a second opening into the second cavity, and (iii) a transition portion extending between the first opening and the second opening, the transition portion comprising a forward portion and a rear portion; and (e) a vacuum insulated panel disposed proximate the rear portion of the transition portion.

17 Claims, 16 Drawing Sheets

(56) References Cited

U.S. PATENT DOCUMENTS

| | | | | |
|---|---|---|---|---|
| 2015/0159937 | A1* | 6/2015 | Jang | B32B 17/061 428/630 |
| 2015/0192356 | A1* | 7/2015 | Kang | F25D 23/064 312/406.1 |
| 2019/0101320 | A1 | 4/2019 | Dherde et al. | |
| 2019/0128593 | A1* | 5/2019 | Deka | F16L 59/065 |
| 2019/0154328 | A1 | 5/2019 | Dherde et al. | |
| 2019/0162356 | A1* | 5/2019 | Allard | F25D 23/062 |
| 2019/0162465 | A1 | 5/2019 | Allard et al. | |
| 2019/0170431 | A1* | 6/2019 | Naik | F25D 23/064 |
| 2019/0310011 | A1* | 10/2019 | Marinello | F25D 23/066 |
| 2020/0141628 | A1 | 5/2020 | Krishna et al. | |
| 2021/0102747 | A1 | 4/2021 | Deka | |
| 2021/0102748 | A1* | 4/2021 | Stewart | F25D 23/085 |
| 2021/0325106 | A1* | 10/2021 | Marinello | F25D 23/085 |
| 2021/0356195 | A1 | 11/2021 | Deka et al. | |
| 2022/0221099 | A1* | 7/2022 | Ekshinge | F25D 23/062 |

* cited by examiner

REFRIGERATOR CABINET WITH A TRIM BREAKER AND VACUUM INSULATED PANEL ASSOCIATED WITH THE TRIM BREAKER

BACKGROUND OF THE DISCLOSURE

The present disclosure generally relates to a refrigerator, and more specifically, to a refrigerator with vacuum insulated components.

Some refrigerators include a cabinet that is vacuum insulated. For example, the cabinet might include an outer wrapper, an inner liner, and an insulating cavity disposed between the outer wrapper and the inner liner. The insulating cavity can have a reduced pressure relative to an external environment in order to reduce heat transfer. The cabinet can further include a trim breaker to couple the outer wrapper and the inner liner together, with the trim breaker defining the insulating cavity along with the outer wrapper and the inner liner.

SUMMARY OF THE DISCLOSURE

However, there is a problem in that heat transfer in the vicinity of the trim breaker may be suboptimal, resulting in the refrigerator suboptimally consuming energy.

The present disclosure addresses that problem with a vacuum insulated panel disposed next a portion of the trim breaker that extends between doors associated with the refrigerator. The presence of the vacuum insulated panel next to the trim breaker reduces thermal transfer from an external environment, between the doors, through the trim breaker, and into a storage compartment of the refrigerator.

According to one aspect of the present disclosure, a cabinet for a refrigerator comprises: (a) a first inner liner defining a first cavity; (b) a second inner liner defining a second cavity; (c) an outer wrapper at least partially surrounding the first inner liner and the second inner liner; (d) a trim breaker coupling the outer wrapper, the first inner liner, and the second inner liner together, the trim breaker comprising (i) a first opening into the first storage compartment, (ii) a second opening into the second storage compartment, and (iii) a transition portion extending between the first opening and the second opening, the transition portion comprising a forward surface and a rear surface; and (e) a vacuum insulated panel disposed proximate the rear surface of the transition portion.

According to another aspect of the present disclosure, a cabinet for a refrigerator comprises: (a) an inner liner defining a cavity; (b) an outer wrapper at least partially surrounding the inner liner; (c) a trim breaker coupling the outer wrapper and the inner liner together, the trim breaker comprising an opening into the storage compartment, with the trim breaker, the outer wrapper, and the inner liner together defining an insulating cavity that has a reduced pressure compared to atmospheric pressure; and (d) a vacuum insulated panel within the cavity; wherein, only the trim breaker separates the vacuum insulated panel from the insulating cavity.

According to yet another aspect of the present disclosure, a cabinet for a refrigerator comprises: (a) a first inner liner defining a first cavity; (b) a second inner liner defining a second cavity disposed below the first cavity; (c) an outer wrapper at least partially surrounding the inner liner and the second inner liner; (d) a trim breaker coupling the outer wrapper, the inner liner, and the second inner liner together, the trim breaker defining a first opening into the first cavity and a second opening into the second cavity; and (e) a vacuum insulated panel disposed within the second cavity, wherein, the trim breaker is shaped and disposed to be rearward of both (i) a first seal of a drawer or door providing selective access into the first cavity and (ii) a second seal of a second drawer or door providing selective access into the second storage cavity, and wherein, the trim breaker is further disposed to be between the second seal and the vacuum insulation panel.

These and other features, advantages, and objects of the present disclosure will be further understood and appreciated by those skilled in the art by reference to the following specification, claims, and appended drawings.

Figure 1:
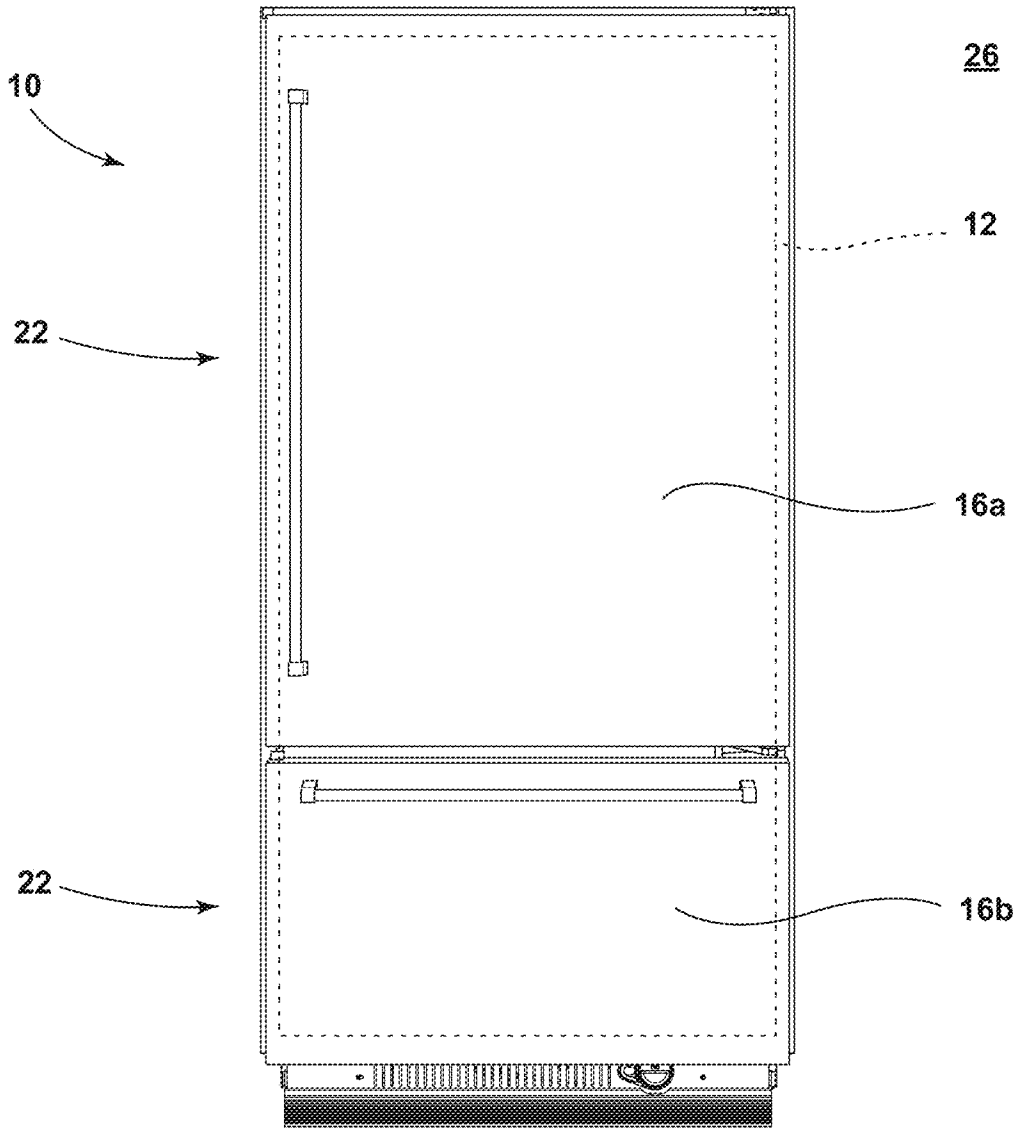
FIG. 1 is an elevation view of a refrigerator of the present disclosure, illustrating doors in their closed position and a cabinet.

The components in the figures are not necessarily to scale, emphasis instead being placed upon illustrating the principles described herein.

DETAILED DESCRIPTION

The present illustrated embodiments reside primarily in combinations of method steps and apparatus components related to a refrigerator. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

Figure 4:
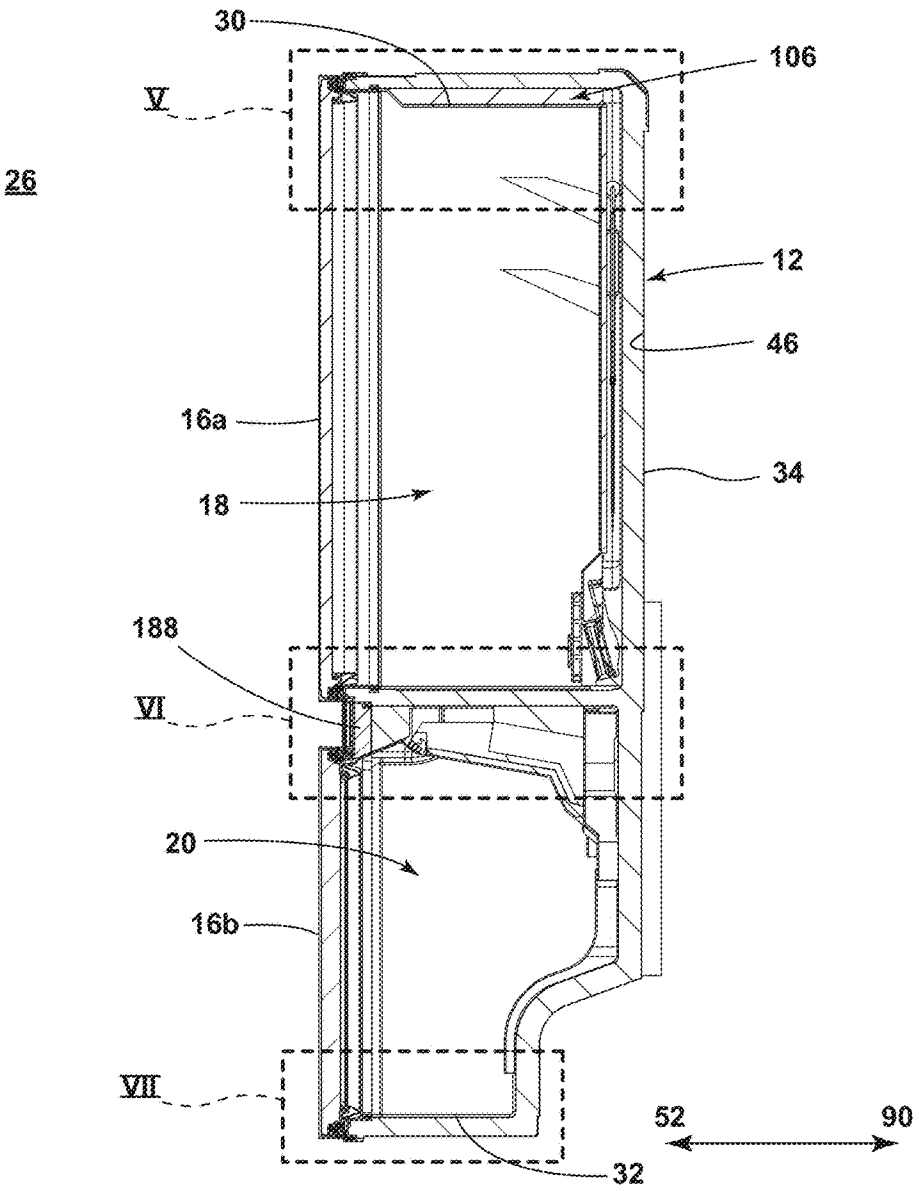
FIG. 4 is an elevation view of a cross-section of the cabinet taken through line IV-IV of FIG. 3, illustrating a vacuum insulated panel positioned to insulate the space between the doors.

For purposes of description herein, the terms "upper," "lower," "right," "left," "rear," "front," "vertical," "horizontal," "above," and "below" and derivatives thereof shall relate to the disclosure as oriented in FIGS. 1 and 4. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
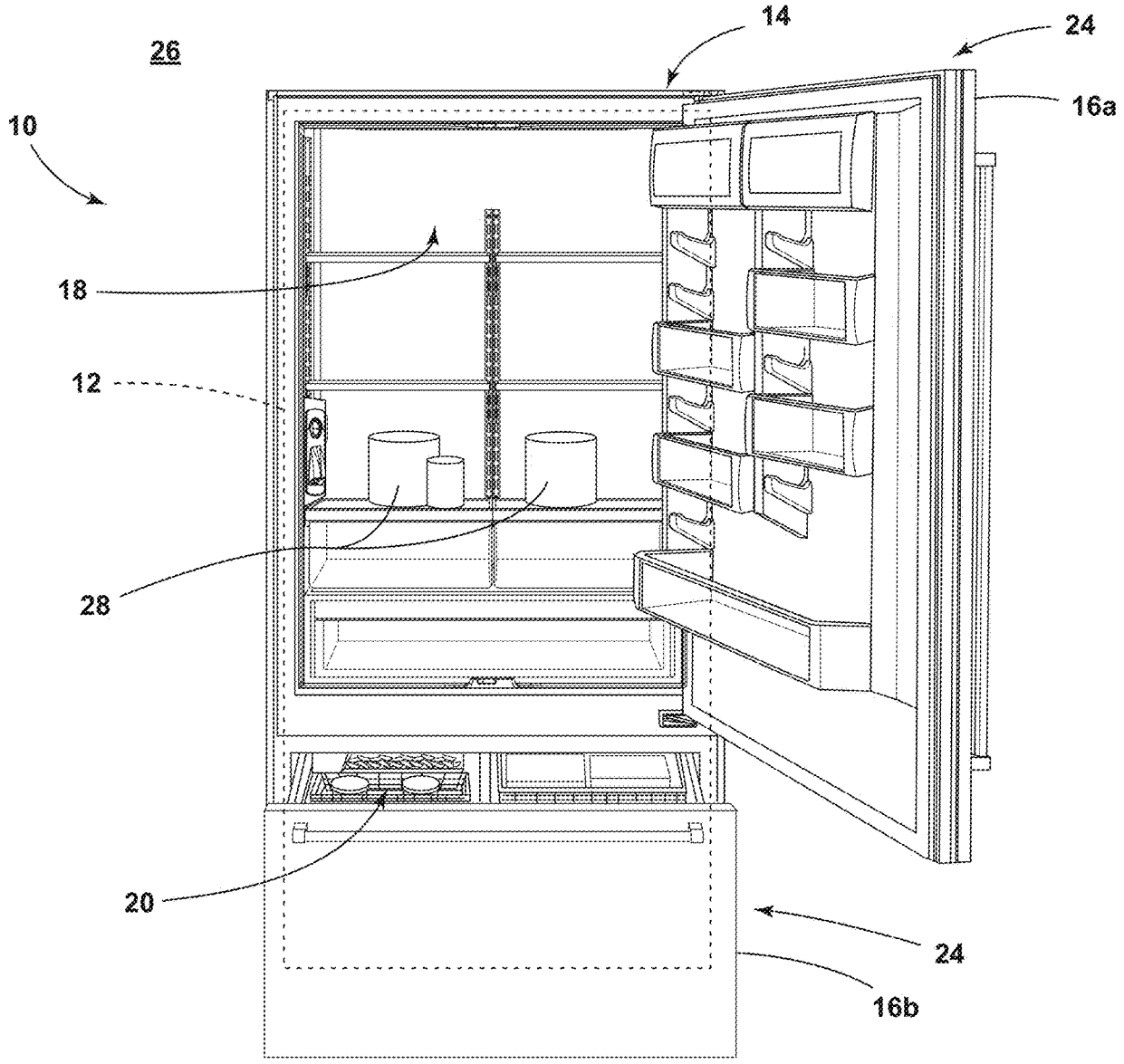
FIG. 2 is an elevation view of the refrigerator of FIG. 1, illustrating the doors in their open position revealing a first storage compartment and a second storage compartment provided by the cabinet.
Figure 3:
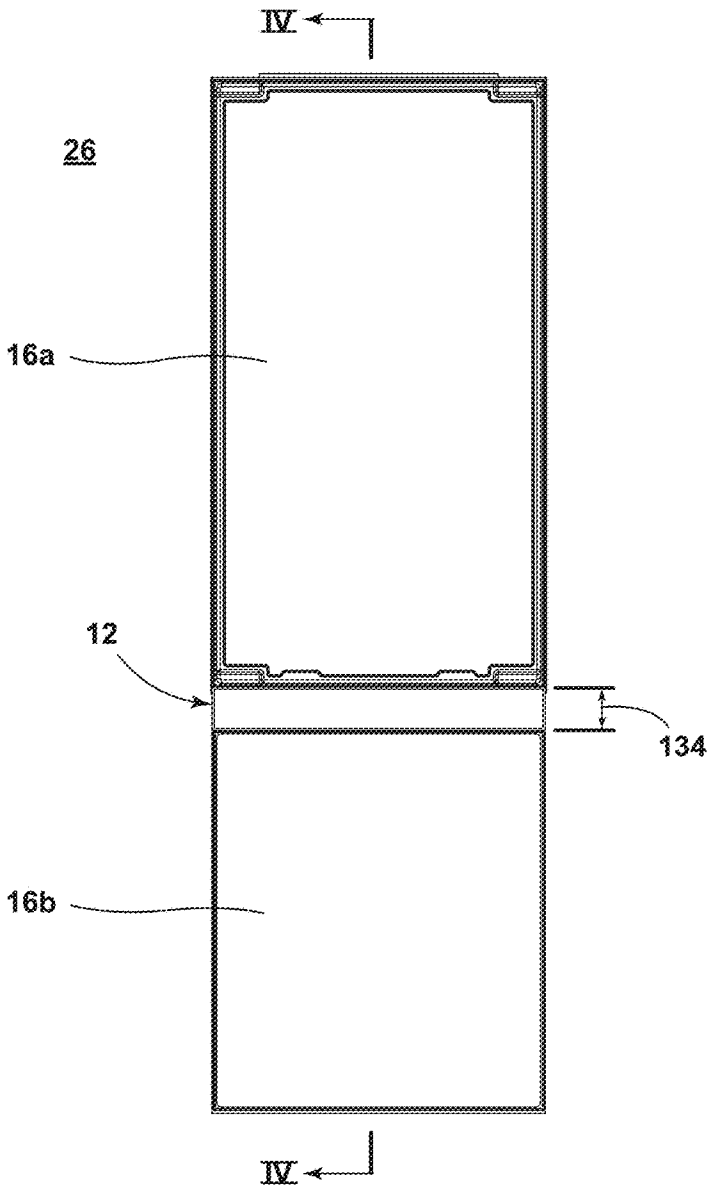
FIG. 3 is an elevation view of the cabinet, illustrating a space between the doors.

Referring to FIGS. 1 and 2, a refrigerator 10 of the present disclosure includes a cabinet 12, a wrapper 14 partially covering the cabinet 12, and one or more doors 16*a*, 16*b* associated with the cabinet 12. "Doors" here include both doors and drawers. The cabinet 12 defines a first storage compartment 18 and a second storage compartment 20. The second storage compartment 20 can be disposed below the first storage compartment 18, as in the illustrated embodiments. In other instances, the first storage compartment 18 can be disposed side-by-side with the second storage compartment 20. The doors 16*a*, 16*b* provide selective access to the first storage compartment 18 and the second storage compartment 20. For example, the doors 16*a*, 16*b* can be manipulated to move to, from, and between a closed position 22 (FIG. 1) and an open position 24 (FIG. 2). In the closed position 22 of the doors 16*a*, 16*b*, access from an external environment 26 to the first storage compartment 18 and the second storage compartment 20 is denied. However, in the open position 24 of the doors 16*a*, 16*b*, access from the external environment 26 to the first storage compartment 18 and the second compartment 20 is allowed. The refrigerator 10 can have any orientation, such as French door, side-by-side, bottom freezer, top freezer, counter depth, built-in, or stand alone, among other possibilities. One of the first storage compartment 18 and the second storage compartment 20 can be configured to accept items 28 (e.g., food) for storage at a temperature above 0° C. but below room temperature. The other of the first storage compartment 18 and the second storage compartment 20 can be configured to accept items 28 for storage at a temperature less than or equal to 0° C.

Referring now to FIGS. 3-16, the cabinet 12 includes a first inner liner 30, a second inner liner 32, an outer wrapper 34, and a trim breaker 36. The outer wrapper 34 at least partially surrounds the first inner liner 30 and the second inner liner 32. For example, the outer wrapper 34 includes a top wall 38, a bottom wall 40 that opposes top wall 38, side walls 42, 44 that oppose each other, and a rear wall 46. The top wall 38, the bottom wall 40, the side walls 42, 44, and the rear wall 46 define an outer cavity 48. The outer wrapper 34 includes an edge 50 disposed forward 52 of the side walls 42, 44, the rear wall 46, the top wall 38, and the bottom wall 40 that defines an opening 54 into the outer cavity 48 of the outer wrapper 34. The outer wrapper 34 has an exterior surface 56 that faces the external environment 26. The first inner liner 30 includes a top wall 58, a bottom wall 60 that opposes the top wall 58, side walls 62, 64 that oppose each other, and a rear wall 66. The top wall 58, the bottom wall 60, the side walls 62, 64, and the rear wall 66 define a first inner cavity 68. The first inner cavity 68 bounds the first storage compartment 18 but the first storage compartment 18 need not be coextensive with (e.g., can be less voluminous than) the first inner cavity 68. The first inner liner 30 includes an edge 70 disposed forward 52 of the side walls 62, 64, the rear wall 66, the top wall 58, and the bottom wall 60 that defines an opening 72 into the chamber of the first inner liner 30. The second inner liner 32 includes a top wall 74, a bottom wall 76 that opposes the top wall 74, side walls 78, 80 that oppose each other, and a rear wall 82. The top wall 74, the bottom wall 76, the side walls 78, 80, and the rear wall 82 define a second inner cavity 84. The second inner cavity 84 bounds the second storage compartment 20 but the second storage compartment 20 need not be coextensive with (e.g., can be less voluminous than) the second inner cavity 84. The second inner cavity 84 includes an edge 86 disposed forward 52 of the side walls 78, 80, the rear wall 82, the top wall 74, and the bottom wall 76 that defines an opening 88 into the second inner cavity 84 of the second inner liner 32.

The first inner liner 30 and the second inner liner 32 are disposed within the outer cavity 48 of the outer wrapper 34. In the embodiments illustrated, the first inner liner 30 is disposed above the second inner liner 32. The rear wall 46 of the outer wrapper 34 is disposed rearward 90 of both the rear wall 66 of the first inner liner 30 and the rear wall 82 of the second inner liner 32. In addition, in the embodiments illustrated, the top wall 38 of the outer wrapper 34 is disposed above the top wall 58 of the first inner liner 30, and the bottom wall 40 of the outer wrapper 34 is disposed below the bottom wall 76 of the second inner liner 32. The side walls 42, 44 of the outer wrapper 34 are disposed laterally outward of both (i) the side walls 62, 64 of the first inner liner 30, respectively, and (ii) the side walls 78, 80 of the second inner liner 32, respectively. The bottom wall 60 of the first inner liner 30 is disposed above and faces the top wall 74 of the second inner liner 32.

As mentioned, the cabinet 12 further includes the trim breaker 36. The trim breaker 36 includes a forward side 92 that faces forward 52 and a rear side 94 that faces rearward 90. The trim breaker 36 couples the outer wrapper 34, the first inner liner 30, and the second inner liner 32 together. For example, in embodiments, the trim breaker 36 includes an outer slot 96 at the rear side 94 with an opening 97 disposed rearward 90. The edge 50 of the outer wrapper 34 is disposed within the outer slot 96 of the trim breaker 36. In addition, the trim breaker 36 includes a first inner slot 98 at the rear side 94 with an opening 100 disposed rearward 90. The edge 70 of the first inner liner 30 is disposed within the first inner slot 98 of the trim breaker 36. Further, the trim breaker 36 includes a second inner slot 102 at the rear side 94 with an opening 104 disposed rearward 90. The edge 86 of the second inner liner 32 is disposed within the second inner slot 102 of the trim breaker 36. The edges 50, 70, 86 can be secured within the slots 96, 98, 102 in an air-tight manner through the use of adhesives, tapes, sealants, and the like. The trim breaker 36, in some instances, is formed of plastic. However, other materials are envisioned.

The trim breaker 36, the outer wrapper 34, the first inner liner 30, and the second inner liner 32 together define an insulating cavity 106. In embodiments, the outer wrapper 34 and the first inner liner 30 are disposed relative to each other so that (i) a space 108 separates the top wall 38 of the outer wrapper 34 from the top wall 58 of the first inner liner 30, (ii) a space 110 separates the rear wall 46 of the outer wrapper 34 from the rear wall 66 of the first inner liner 30, (iii) a space 112 separates the side wall 42 of the outer wrapper 34 from the side wall 62 of the first inner liner 30, and (iv) a space 114 separates the side wall 44 of the outer wrapper 34 from the side wall 64 of the first inner liner 30. The first inner liner 30 and the second inner liner 32 are disposed relative to each other so that a space 116 separates the bottom wall 60 of the first inner liner 30 and the top wall 74 of the second inner liner 32. The outer wrapper 34 and the second inner liner 32 are disposed relative to each other so that (i) a space 118 separates the bottom wall 40 of the outer wrapper 34 from the bottom wall 76 of the second inner liner 32, (ii) a space 120 separates the rear wall 46 of the outer wrapper 34 from the rear wall 82 of the second inner liner 32, (iii) a space 122 separates the side wall 42 of the outer wrapper 34 from the side wall 78 of the second inner liner 32, and (iv) a space 124 separates the side wall 44 of the outer wrapper 34 from the side wall 80 of the second inner liner 32. In embodiments, the spaces 108-124 are contiguous and together define the insulating cavity 106. The rear side 94 of the trim breaker 36 faces the insulating cavity 106.

In embodiments, the insulating cavity 106 has a reduced pressure compared to atmospheric pressure. In such embodiments, the cabinet 12 may be referred to as a vacuum-insulated cabinet 12. Air can be evacuated from the insulating cavity 106 to lower the pressure within the insulating cavity 106. The insulating cavity 106 is then sealed and the reduced pressure is maintained. As mentioned above, all of the outer wrapper 34, the first inner liner 30, and the second inner liner 32 are coupled to the trim breaker 36 in an air-tight manner. Further, the outer wrapper 34, the first inner liner 30, the second inner liner 32 are formed of a material (such as a plastic) that is not porous to air. Thus, air does not readily migrate from the external environment 26 and into the insulating cavity 106 so as to equalize the pressure within the insulating cavity 106 with atmospheric pressure.

In embodiments, the cabinet 12 further includes a core insulation material 126 within the insulating cavity 106. The core insulation material 126 can be disposed at all of the spaces 108-124 of the insulating cavity 106. The core insulation material 126 reduces the transfer of heat from the external environment 26, through the cabinet 12, and into the first storage compartment 18 and the second storage compartment 20. In embodiments, the core insulation material 126 is fumed silica. Other compositions for the core insulation material 126 are envisioned.

The trim breaker 36 includes a first opening 128 into first inner cavity 68 of the first inner liner 30. In addition, the trim breaker 36 includes a second opening 130 into the second inner cavity 84 of the second inner liner 32.

The trim breaker 36 further includes a transition portion 132 that extends between the first opening 128 and the second opening 130. In embodiments, such as that illustrated, the transition portion 132 partially covers the opening 88 into the second inner cavity 84 that the second inner liner 32 forms (see, e.g., FIG. 6). The transition portion 132 includes a forward portion 176 at the forward side 92 and a rear portion 178 at the rear side 94. Among other purposes and benefits, the transition portion 132 allows for there to be space 134 between the doors 16*a*, 16*b* yet still allows the door 16*b* to seal against the cabinet 12 in the closed position 22, without having to increase the space 116 between the first inner liner 30 and the second inner liner 32.

In embodiments, the trim breaker 36 includes a vertical wall system 136. The vertical wall system 136 is a series of interconnected walls that are oriented vertically. The vertical wall system 136 is contiguous with the first opening 128, the second opening 130, and the transition portion 132. The vertical wall system 136 includes a wall 138 (see, e.g., FIGS. 5 and 6) with a forward surface 140 at the forward side 92 that faces forward 52 and is positioned to interact, directly or indirectly, with a seal 142 of the door 16*a* associated with the first storage compartment 18. The wall 138 is disposed rearward 90 of the seal 142 and the door 16*a*. The wall 138 further includes a rear surface 144. The rear surface 144 of the wall 138 faces rearward 90 and at least partially defines the insulating cavity 106. The vertical wall system 136 further includes a wall 146 (see, e.g., FIG. 7) with a forward surface 148 at the forward side 92 that is positioned to interact, directly or indirectly, with a seal 150 of the door 16*b*. The wall 146 is disposed rearward 90 of the seal 150 and the door 16*b*. The wall 146 further includes a rear surface 152. The rear surface 152 of the wall 146 at least partially defines the insulating cavity 106.

The trim breaker 36 further includes a first inner wall 154 that extends rearward 90 from the vertical wall system 136 (e.g., wall 138) at the rear side 94. The first inner wall 154 transitions to the first inner slot 98 that accepts the edge 70 of the first inner liner 30. The first inner wall 154 extends around the first opening 128. The first inner wall 154 includes horizontal portions 156, 158 that couple to the top wall 58 and the bottom wall 60 respectively of the first inner liner 30 via the first inner slot 98. Further, the first inner wall 154 includes vertical portions 160, 162 that couple to the side walls 62, 64 respectively of the first inner liner 30 via the first inner slot 98. The horizontal portions 156, 158 oppose each other, and the vertical portions 160, 162 oppose each other. The horizontal portion 158 of the first inner wall 154 is disposed near the transition portion 132 of the trim breaker 36.

In embodiments, the transition portion 132 of the trim breaker 36 extends downward substantially vertically from the horizontal portion 158 of the first inner wall 154 that is forward of the bottom wall 60 of the first inner liner 30. The transition portion 132 of the trim breaker 36 forms part of the second opening 130, such as a top portion 164 of the second opening 130 when the first opening 128 is disposed above the second opening 130.

The trim breaker 36 further includes a second inner wall 166 at the rear side 94 that extends rearward 90 from the vertical wall system 136 (e.g., wall 138 and wall 146). The second inner wall 166 transitions to the second inner slot 102 that accepts the edge 86 of the second inner liner 32. The second inner wall 166 extends around the second opening 130 and into the transition portion 132. The second inner wall 166 includes horizontal portions 168, 170 that couple to the top wall 74 and the bottom wall 76 respectively of the second inner liner 32 via the second inner slot 102. The horizontal portion 168 of the second inner wall 166 runs parallel to the horizontal portion 158 of the first inner wall 154 that are separated by the space 116. Further, the second inner wall 166 includes vertical portions 172, 174 that couple to the side walls 78, 80 respectively of the second inner liner 32 via the second inner slot 102. The horizontal portions 168, 170 oppose each other, and the vertical portions 172, 174 oppose each other.

Sections 172*a*, 174*a* of the vertical portions 172, 174 are disposed at the transition portion 132. The sections 172*a*, 174*a* oppose each other and extend from the second opening 130 toward the first opening 128 terminating at the horizontal portion 168. The sections 172*a*, 174*a*, and the horizontal portion 168 of the second inner wall 166, together with rear portion 178 of the transition portion 132, form a receiving portion 180.

The cabinet 12 further includes a vacuum insulated panel 188 positioned to insulate the second inner cavity 84 of the second inner liner 32. The vacuum insulated panel 188 is disposed proximate the rear portion 178 of the transition portion 132. The vacuum insulated panel 188 is separated from the insulating cavity 106 that the trim breaker 36, the outer wrapper 34, the first inner liner 30, and the second inner liner 32 form. The vacuum insulated panel 188 is disposed within, such as nested within, the receiving portion 180 of the trim breaker 36.

The vacuum insulated panel 188 includes a liner 190 with a forward side 192 and a rear side 194. A space 196 separates the forward side 192 from the rear side 194 thus forming a cavity 198 within the liner 190. The cavity 198 has an air pressure that is less than atmospheric pressure. Core insulation material 126 can be disposed within the cavity 198.

The forward side 192 of the vacuum insulated panel 188 faces the rear portion 178 of the transition portion 132 of the trim breaker 36. In embodiments, the forward side 192 of the vacuum insulated panel 188 abuts (e.g., touches) the rear portion 178 of the transition portion 132 of the trim breaker 36.

In embodiments, the vacuum insulated panel 188 occupies substantially all of the receiving portion 180 of the transition portion 132 of the trim breaker 36. In embodiments, elevations of the horizontal portion 168 of the second inner wall 166 and the top portion 164 of the second opening 130 of the trim breaker 36 differ by a height 200 (see, e.g., FIG. 15). The vacuum insulated panel 188 includes a top side 202 and a bottom edge 204 that are separated by a height 206 (see, e.g., FIG. 16). In embodiments, the heights 200, 206 are substantially the same. The sections 172*a*, 174*a* of the vertical portions 172, 174 of the second inner wall 166 at the transition portion 132 are separated by a width 208. The vacuum insulated panel 188 includes sides 210, 212 that are laterally oriented and face in opposite directions. The sides 210, 212 are separated by a width 214. The widths 208, 214 are substantially the same. The vacuum insulated panel 188 can friction-fit between sections 172*a*, 174*a* of the vertical portions 172, 174 of the second inner wall 166 at the transition portion 132. The horizontal portion 168 of the second inner slot 102 extends a depth 216 (see, e.g., FIG. 6) rearward 90 from the rear portion 178 of the transition portion 132. The vacuum insulated panel 188 has a thickness 218 between the forward side 192 and the rear side 194. The depth 216 and the thickness 218 can be substantially the same.

In embodiments, the vacuum insulated panel 188 is vertically oriented. Vertically oriented here means that the height 206 and width 214 (e.g., laterally) of the vacuum insulated panel 188 exceed the thickness 218 (e.g., forward 52-to-rearward 90) of the vacuum insulated panel 188.

As mentioned, the first opening 128 of the trim breaker 36 can be disposed above the second opening 130 of the trim breaker 36, such as when the first inner liner 30 is disposed above the second inner liner 32. The vacuum insulated panel 188 is disposed elevationally below the space 116 of the insulating cavity 106 and is separated from the insulating cavity 106 by only the trim breaker 36, such as the second inner wall 166, and perhaps the second inner slot 102 and the edge 70 of the top wall 58 of first inner liner 30. The vacuum insulated panel 188 is thus disposed rearward 90, below and adjacent to the trim breaker 36.

In embodiments, the cabinet 12 further includes a non-vacuum insulation material 220 disposed directly rearward 90 of the vacuum insulated panel 188. The non-vacuum insulation material 220 can be, for example, expanded polystyrene. However, other compositions are envisioned for the non-vacuum insulation material 220. In embodiments where the first inner liner 30 is disposed above the second inner liner 32, as illustrated, the non-vacuum insulation material 220 is disposed below the top wall 74 of the second inner liner 32 and the space 116 of the insulating cavity 106. The non-vacuum insulation material 220 can extend approximately the entire distance between the side walls 78, 80 of the second inner liner 32.

As mentioned above, the vertical wall system 136 of the trim breaker 36 can include the wall 138 with (i) the forward surface 140 positioned to interact with the seal 142 of the door 16*a* and (ii) the rear surface 144 defining the insulating cavity 106. In embodiments where the first inner liner 30 is disposed above the second inner liner 32, the first inner wall 154 extends rearward 90 from the wall 138 to transition to the first inner slot 98, which engages with the top wall 58 the first inner liner 30. Similarly, the outer slot 96 extends rearward 90 relative to the wall 138 and engages with the top wall 38 of the outer wrapper 34. In these embodiments, the rear surface 144 of the wall 138 of the trim breaker 36, the first inner wall 154, and the outer slot 96 all define a portion of the insulating cavity 106.

In embodiments, the transition portion 132 of the trim breaker 36 is disposed between (i) the seal 150 of the door 16*b* associated with the second storage compartment 20 and (ii) the vacuum insulated panel 188.

Figure 5:
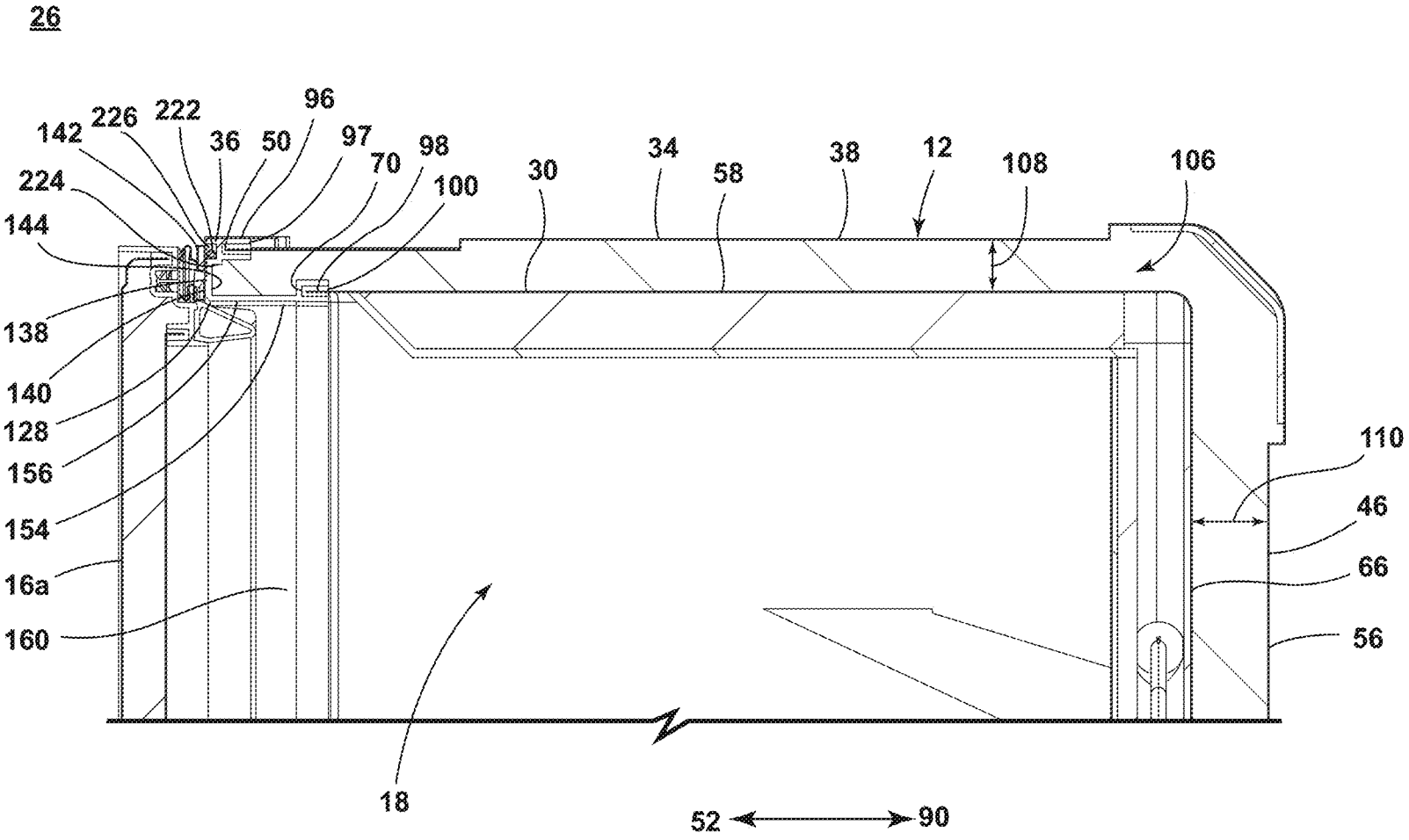
FIG. 5 is a magnified view of area V of FIG. 4, illustrating (i) a first inner liner partially surrounded by an outer wrapper with a space therebetween for an insulating cavity and (ii) a trim breaker with a wall separating the insulating cavity from a seal of one of the doors.
Figure 6:
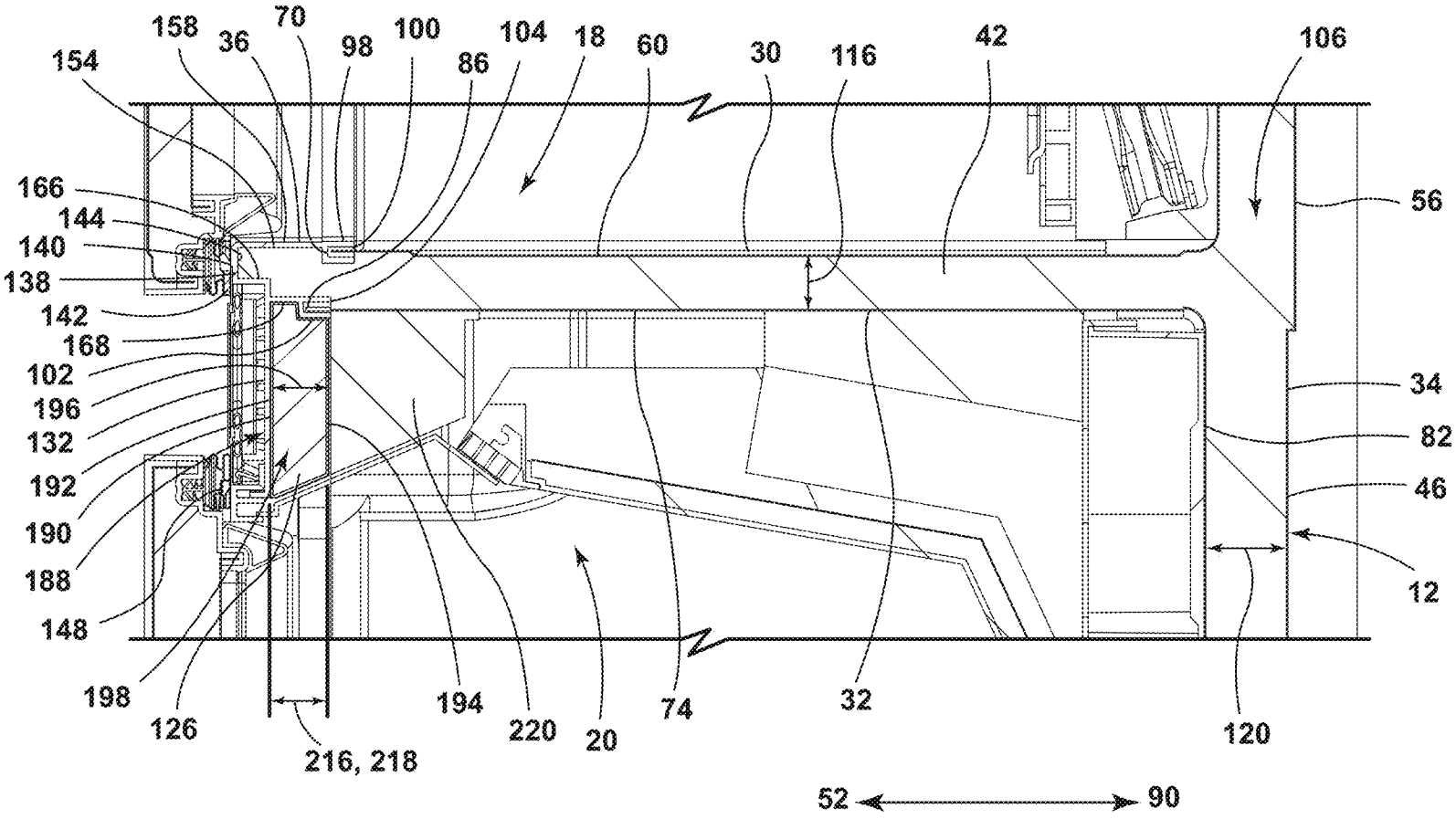
FIG. 6 is a magnified view of area VI of FIG. 4, illustrating (i) a second inner liner below the first inner liner and also partially surrounded by the outer wrapper with a space between both the second inner liner and the first inner liner and the second inner liner and the outer wrapper of the insulating cavity, and (ii) a transition portion of the trim breaker extending below the insulating cavity with the vacuum insulated panel vertically oriented rearward of the trim breaker and below an inner wall of the trim breaker coupled to a top wall of the second inner liner.
Figure 7:
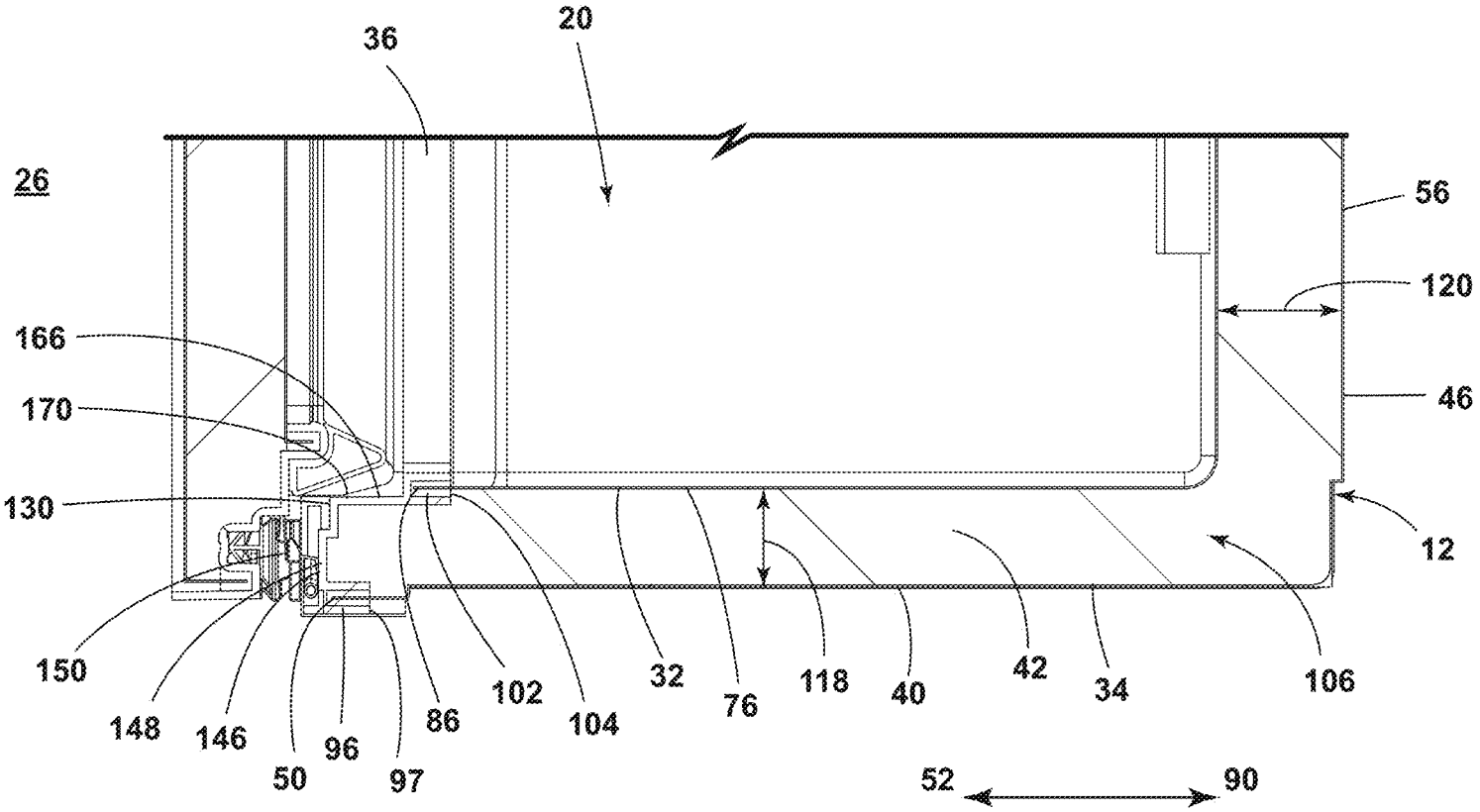
FIG. 7 is a magnified view of area VII of FIG. 4, illustrating a wall of the trim breaker separating a seal of the second door from the insulating cavity defined by the trim breaker, the bottom wall of the second inner liner, and the bottom wall of the outer wrapper.
Figure 8:
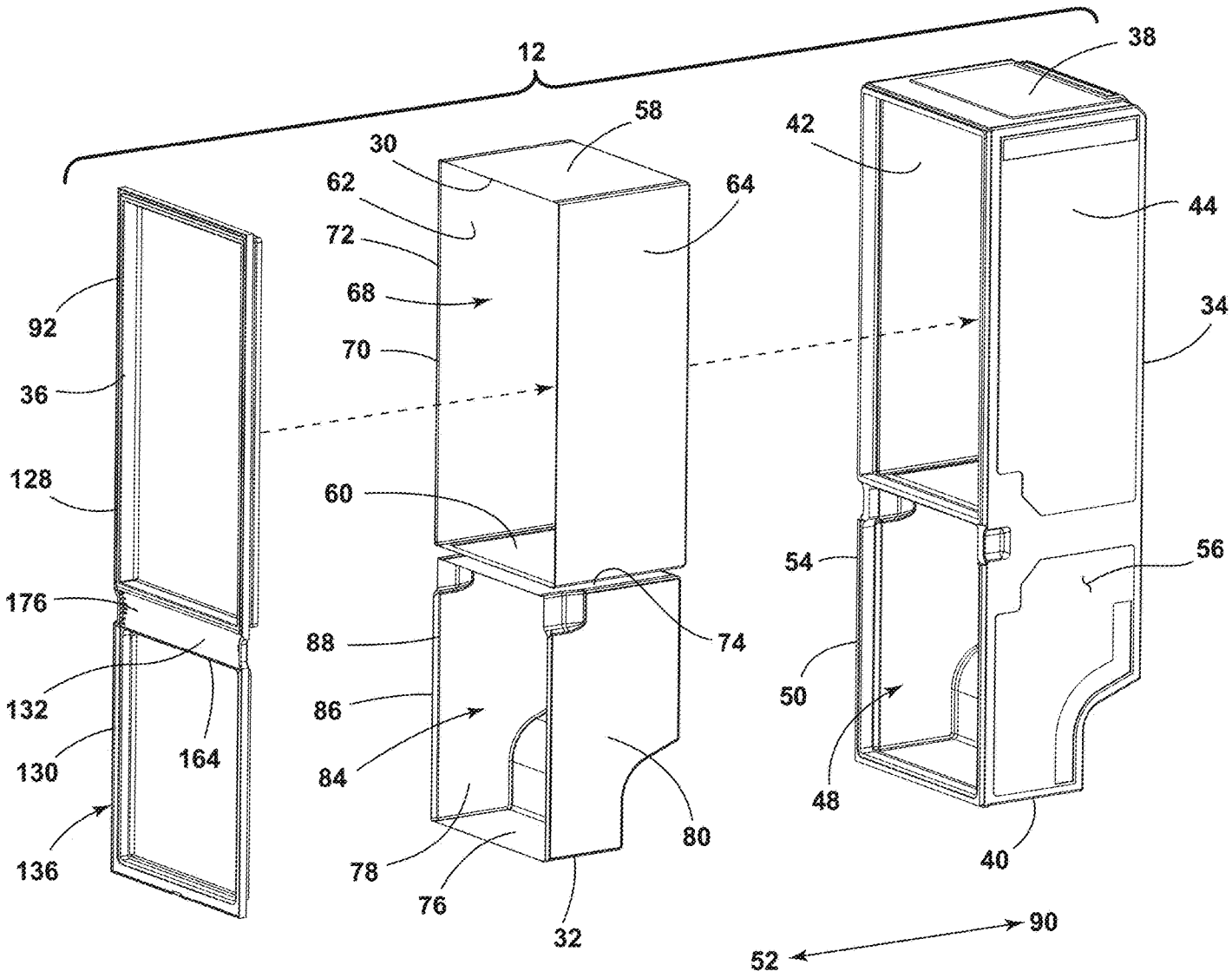
FIG. 8 is a perspective exploded view of components of the cabinet, illustrating the outer wrapper forming an outer cavity within which the first inner liner and the second inner liner are disposed with the trim breaker attaching all of the outer cavity, the first inner liner, and the second inner liner to form the insulating cavity that can be maintained at lower than atmospheric pressure.
Figure 9:
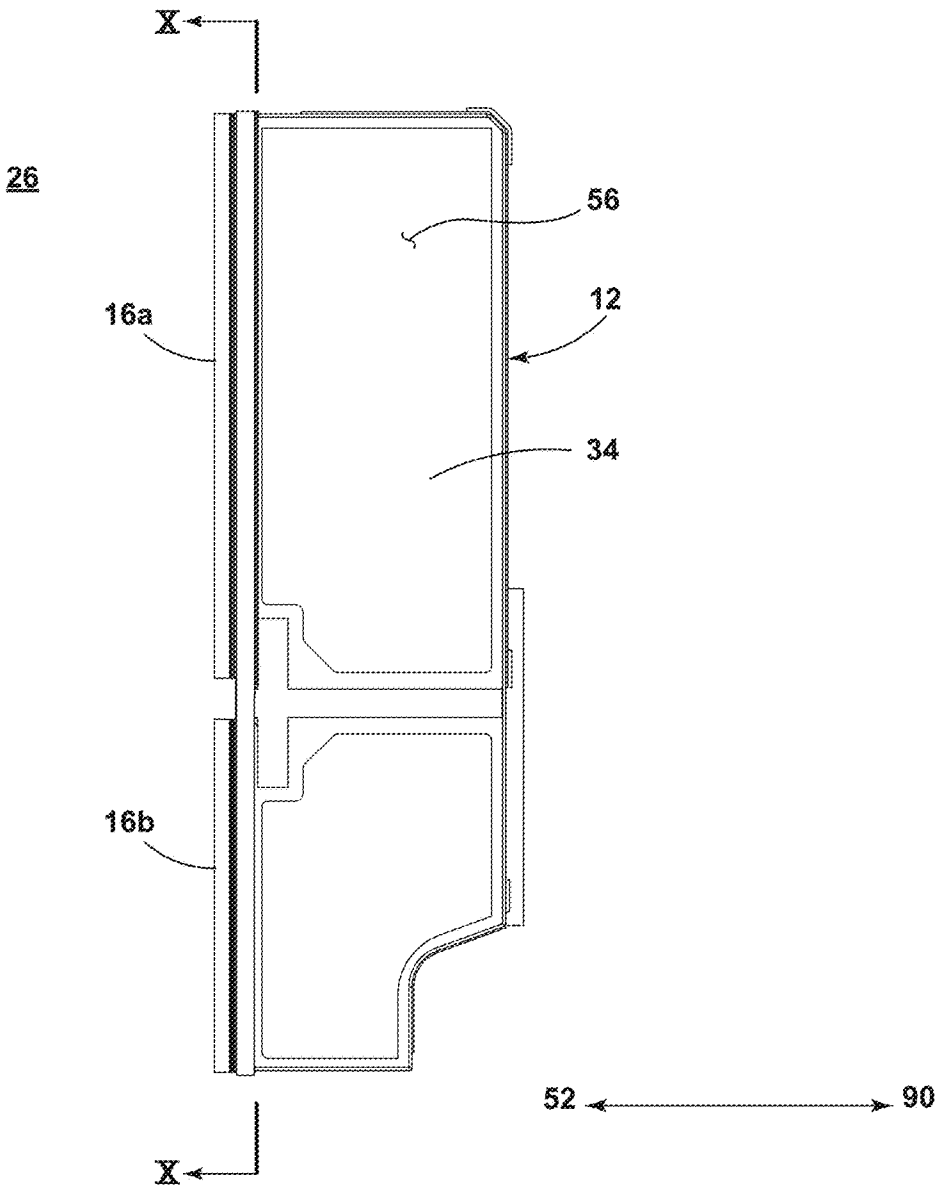
FIG. 9 is a side elevation view of the cabinet, illustrating the outer wrapper having an exterior surface facing the external environment.
Figure 10:
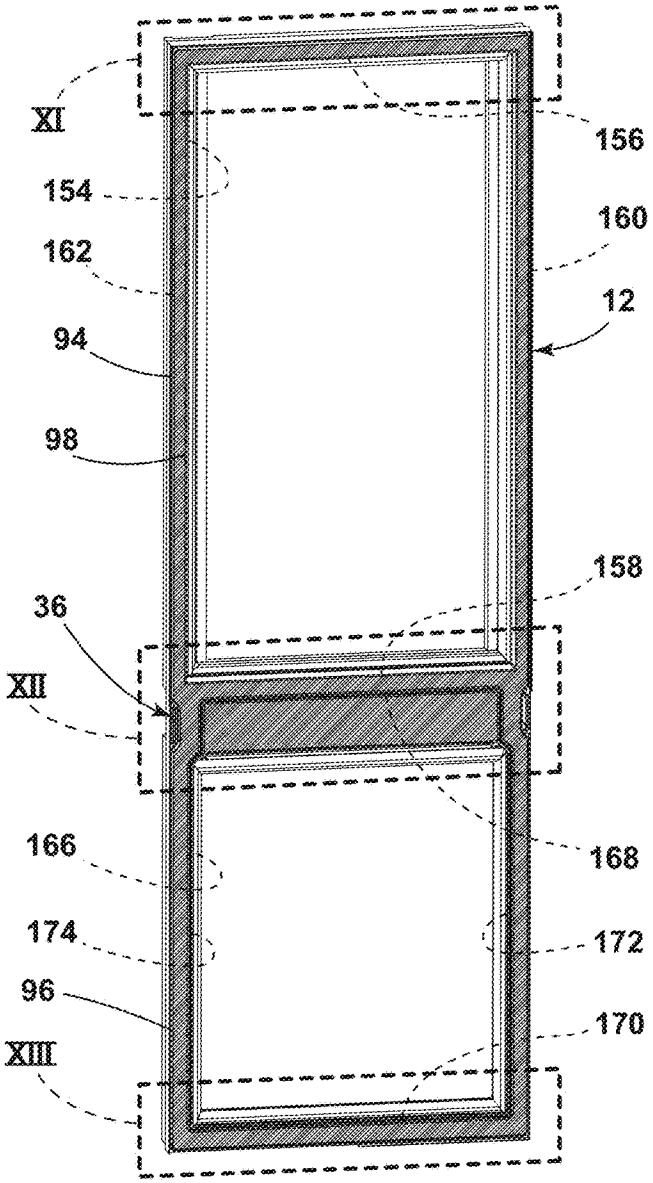
FIG. 10 is an elevation view of a cross-section of the cabinet taken through line X-X of FIG. 9, illustrating the trim breaker including (i) an outer slot extending from a rear side of the trim breaker to receive the outer wrapper, (ii) a first inner wall extending from the rear side leading to a first inner slot to receive the first inner liner, and (iii) a second inner wall extending from the rear side leading to a second inner slot to receive the second inner liner.
Figure 11:
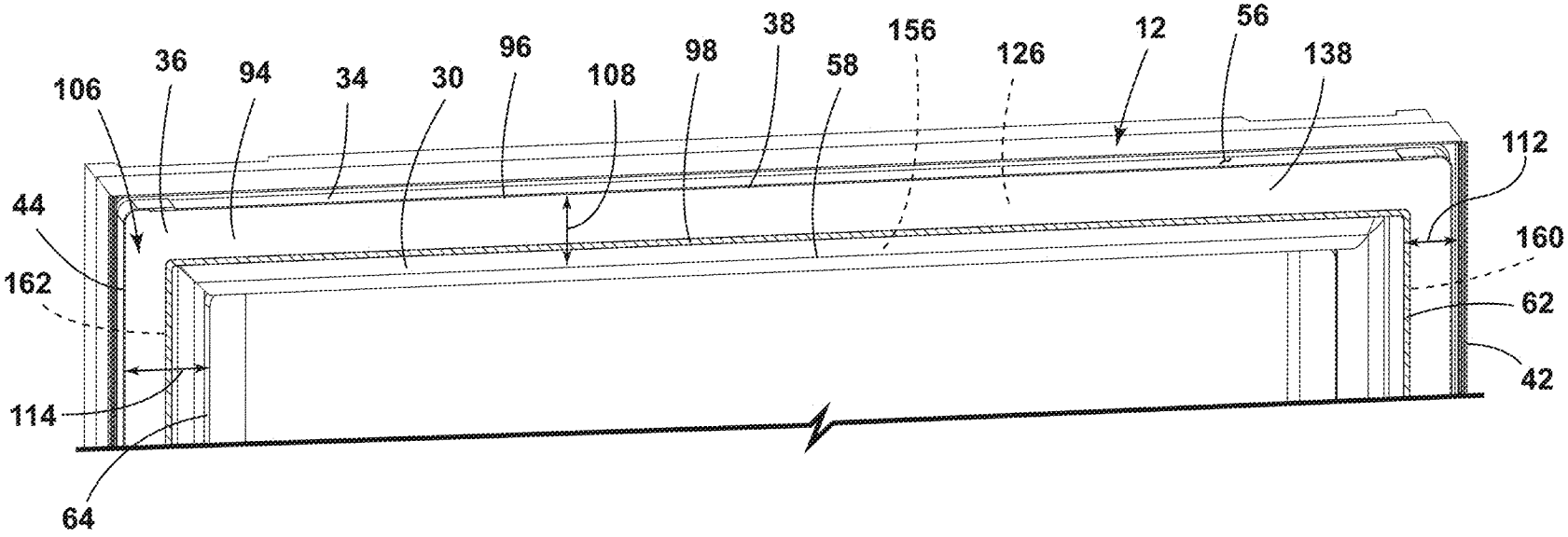
FIG. 11 is a magnified view of area XI of FIG. 10, illustrating a top wall of the outer wrapper separated from a top wall of the first inner liner by a space defining the insulating cavity, and side walls of the outer wrapper separated from side walls of the first inner liner by spaces also defining the insulating cavity.
Figure 12:
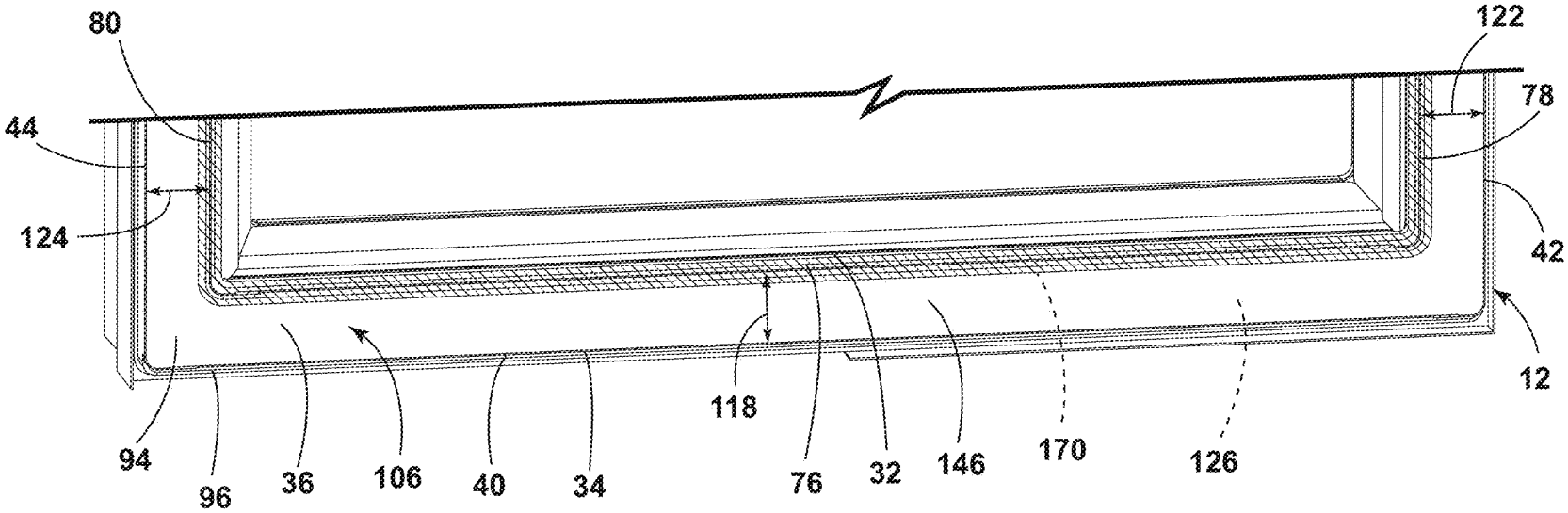
FIG. 12 is a magnified view of area XII of FIG. 10, illustrating a bottom wall of the outer wrapper separated from a bottom wall of the second inner liner by a space also defining the insulating cavity, and side walls of the outer wrapper separated from side walls of the second inner liner by spaces also defining the insulating cavity.
Figure 13:
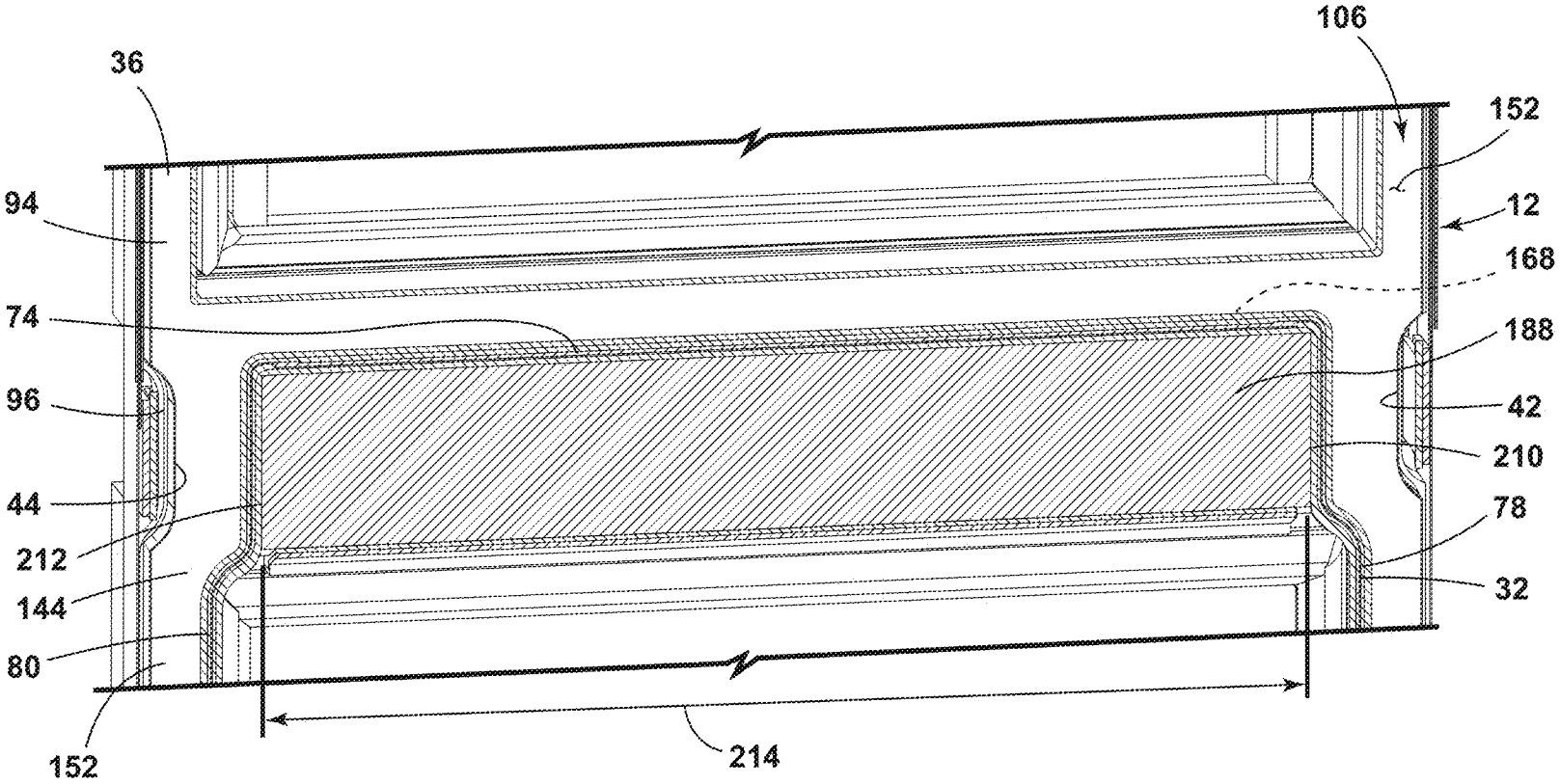
FIG. 13 is a magnified view of area XIII of FIG. 10, illustrating the vacuum insulated panel nested within the transition portion of the trim breaker at the rear side of the trim breaker to insulate the second inner cavity from heat transfer from the external environment through the cabinet at the space between the doors.
Figure 14:
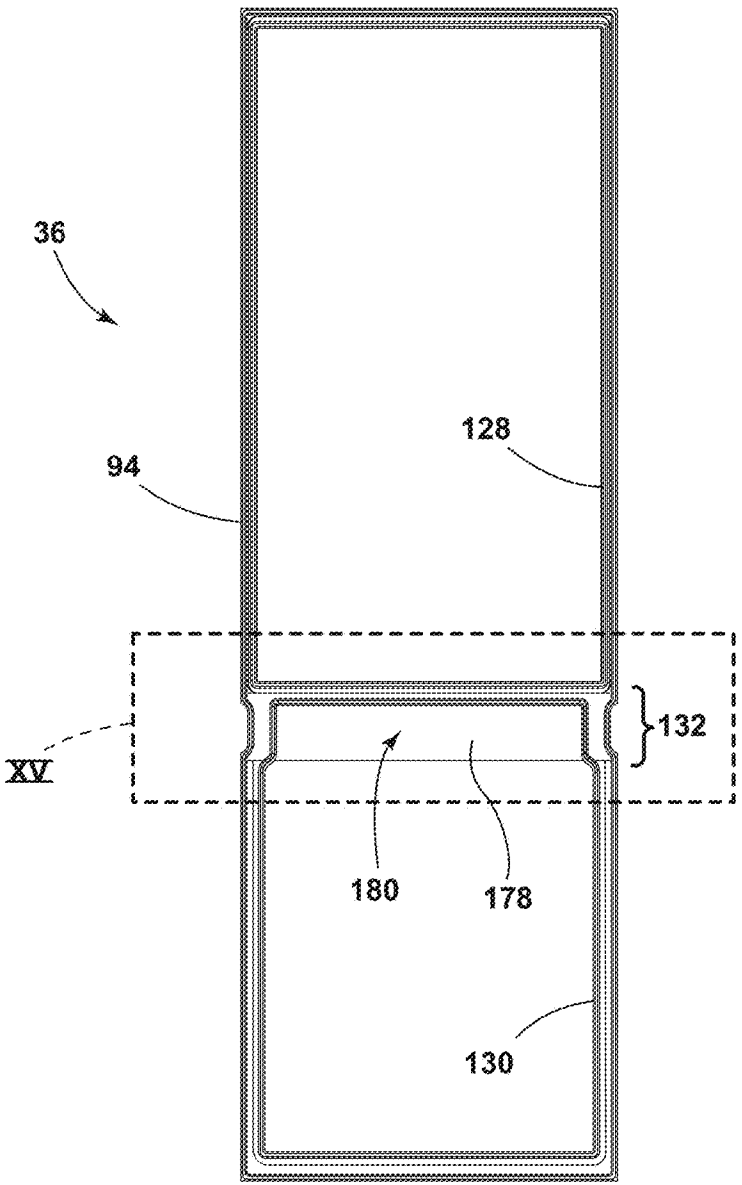
FIG. 14 is an elevation view at the rear side of the trim breaker, illustrating that the transition portion of the trim breaker is disposed between a first opening through the trim breaker and an second opening through the trim breaker.
Figure 15:
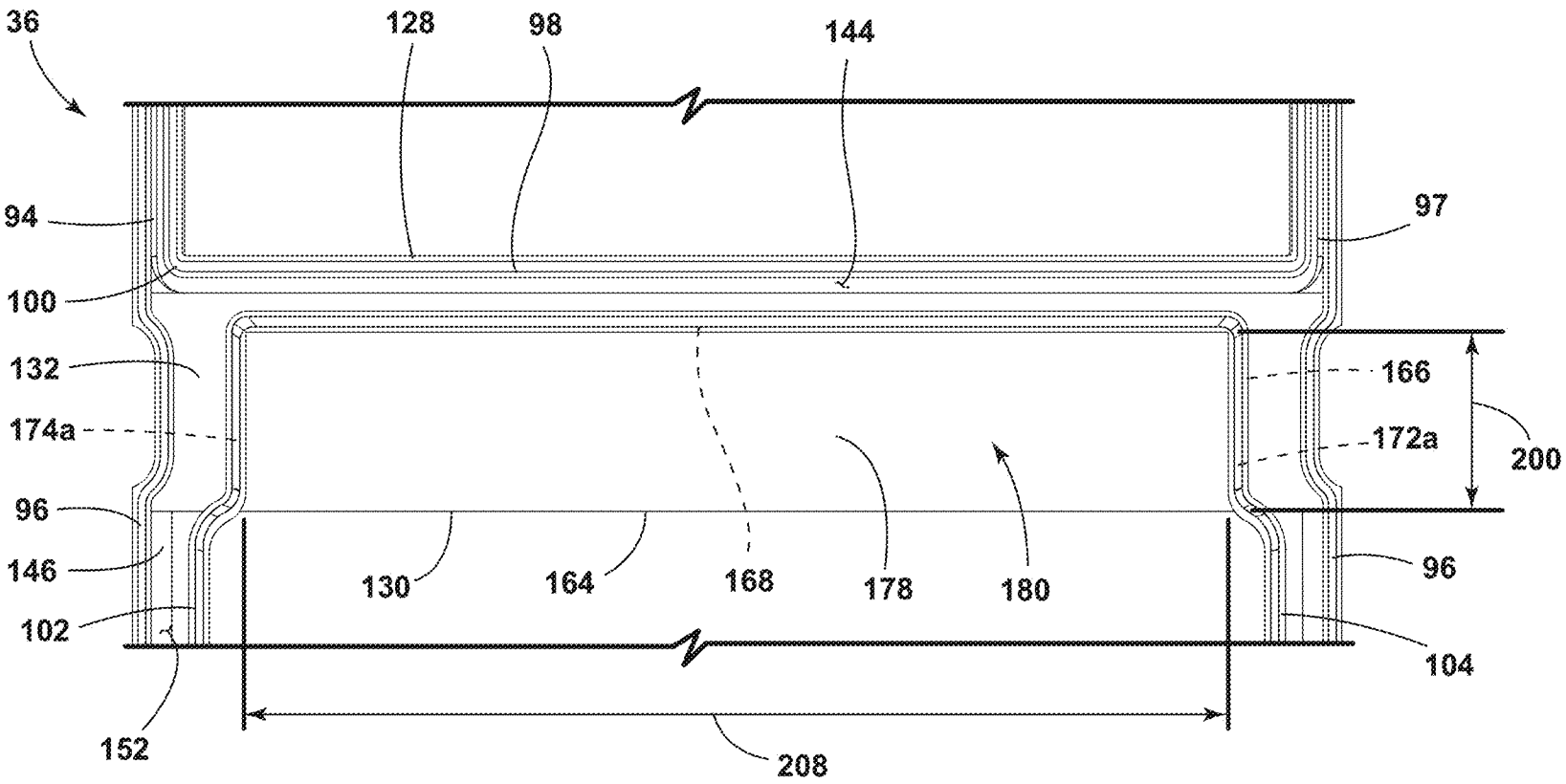
FIG. 15 is a magnified view of area XV of FIG. 14, illustrating the trim breaker including a receiving portion at the transition portion of the trim breaker to receive the vacuum insulated panel that is bound by (i) a horizontal portion of the second inner wall, (ii) opposing sections of the second inner wall that are vertically oriented, and (iii) a rear portion of the trim breaker.
Figure 16:
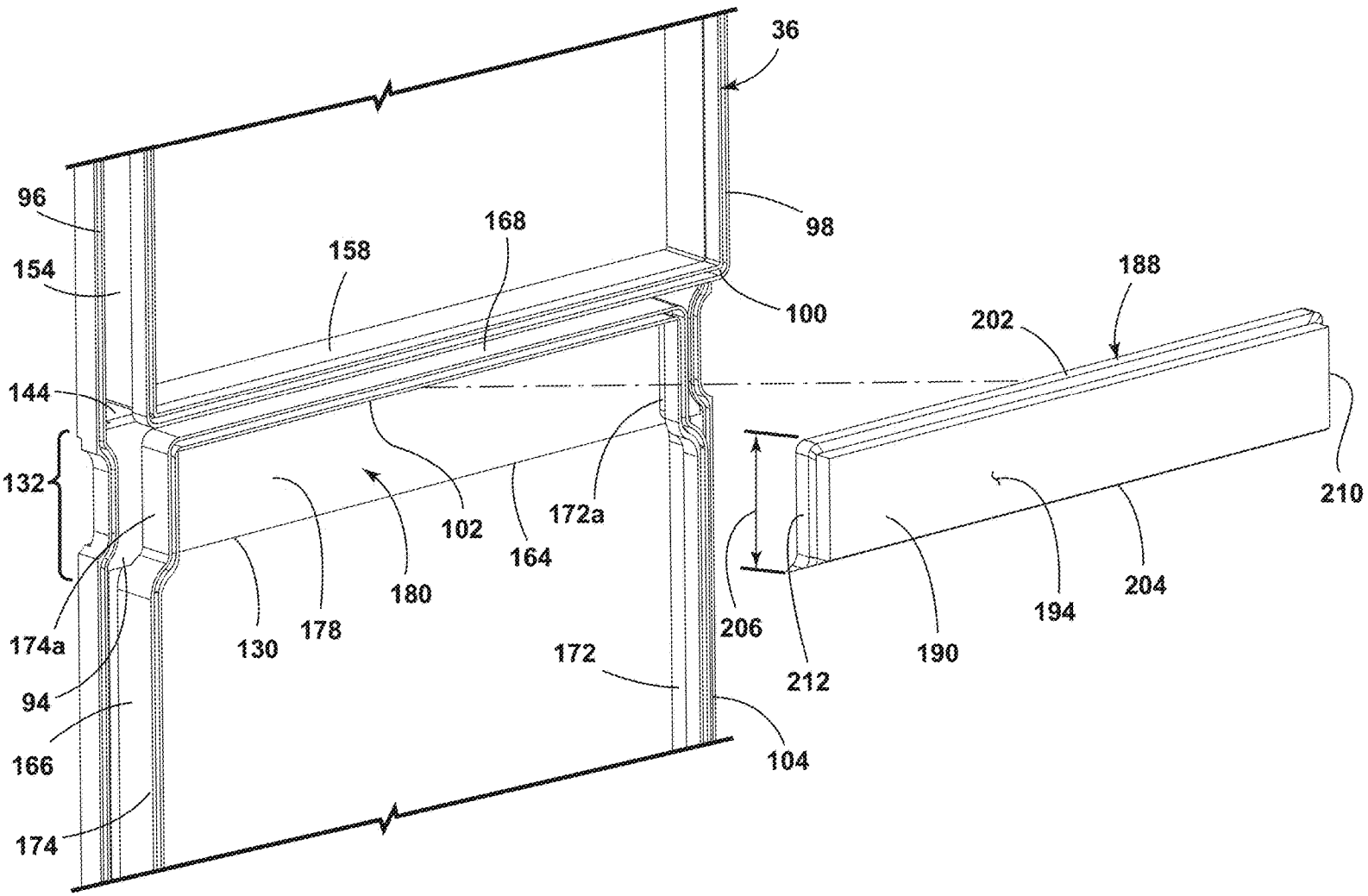
FIG. 16 is a magnified perspective view of area XV of FIG. 14 but this time also illustrating the vacuum insulated panel as including a shape to nest within the receiving portion of the trim breaker at the transition portion of the trim breaker.

In embodiments, the cabinet 12 further includes a heat loop 222 (see FIG. 5). The heat loop 222 transports a fluid that delivers heat to the heat loop 222 and the cabinet 12 proximate the heat loop 222. The delivered heat helps reduce or prevent water condensation upon the cabinet 12 around the seals 142, 150 of the doors 16*a*, 16*b* associated with the cabinet 12. As mentioned, the trim breaker 36 can include the wall 138 with the forward surface 140 that is positioned to contact the seal 142.

The trim breaker 36 can further include a recess 224 adjacent to the wall 138 that is positioned and sized to accept the heat loop 222. The recess 224 can be disposed elevationally overlapping the outer slot 96 and the top wall 38 of the outer wrapper 34. The recess 224 extends rearward 90 from the forward surface 140 that faces the seal 142. The recess 224 can extend around almost an entirety of the first opening 128 and the second opening 130 that the trim breaker 36 forms.

In embodiments, the cabinet 12 further includes a cover 226 attached to the trim breaker 36 that encloses the recess 224 and separates the heat loop 222 from the external environment 26. For example, where the heat loop 222 is disposed forward 52 of the top wall 38 of the outer wrapper 34, the recess 224 of the trim breaker 36 is disposed below, above, and rearward 90 of the heat loop 222 while the cover 226 is disposed forward 52 of the heat loop 222. In embodiments, the cover 226 comprises a ferromagnetic material that is magnetically attracted to a magnet (not illustrated) within the seal 142. The seal 142 could alternatively include the ferromagnetic material and the cover 226 could include the magnet.

The refrigerator 10 including the cabinet 12 of the disclosure improves energy consumption needed to operate the refrigerator 10. In embodiments where the trim breaker 36 is plastic, the trim breaker 36 limits heat transfer from the outer wrapper 34 to the first inner liner 30 and the second inner liner 32. Limiting heat transfer reduces the energy needed to maintain the temperature within the first cavity and the second cavity.

In addition, only the wall 138 of the trim breaker 36 separates portions of the insulating cavity 106 from the seal 142 of the door 16*a*. Thus, the highly insulative insulating cavity 106 is disposed forward 52 as far as possible within the cabinet 12. The forward 52 positioning of the insulating cavity 106 reduces heat transfer out of the first inner cavity 68 through the seal 142 of the door 16*a* compared to if the insulating cavity 106 were pushed rearward 90 to accommodate other components of the refrigerator 10 such as lighting or special adapters to hold the heat loop 222.

Further, the recess 224 into the wall 138 of the trim breaker 36 configured to hold the heat loop 222 around the first opening 128 avoids the need for a special adaptor attached to the trim breaker 36 to hold the heat loop 222. Thus, the wall 138 can be maintained as the only separation between insulating cavity 106 and the seal 142 of the door 16*a*. Again, this allows the insulating cavity 106 to extend forward 52 as far as possible.

Finally, the vacuum insulated panel 188 disposed adjacent to transition portion 132 of the trim breaker 36 reduces heat transfer from the external environment 26, through the trim breaker 36, and into the second inner cavity 84 of the second inner liner 32. As described above, the transition portion 132 of the trim breaker 36 extends between the first opening 128 and the second opening 130 through the trim breaker 36. However, the second opening 130 may not be aligned with the space 116 of the insulating cavity 106 between the first inner liner 30 and the second inner liner 32. For example, as in the illustrated embodiments, the second opening 130 is disposed elevationally below the space 116. Thus, the transition portion 132 of the trim breaker 36 could be a source of relatively high thermal transfer from the external environment 26 into the second inner cavity 84. Placement of the vacuum insulated panel 188 rearward 90 of the transition portion 132 but adjacent to the transition portion 132 limits such thermal transfer through the transition portion 132 of the trim breaker 36. The vacuum insulated panel 188, being vacuum insulated, provides greater insulation against thermal transfer through the transition portion 132 compared to if the transition portion 132 were left uninsulated or if a non-vacuum insulated insulation material were utilized. Studies associated with this disclosure have shown that the combination of the attributes mentioned above result in a refrigerator 10 with 13% less energy consumption than an otherwise identical refrigerator 10 without those attributes. Inclusion of the vacuum insulated panel 188 was a major component of the reduction of energy consumption.

According to a first aspect of the present disclosure, a cabinet for a refrigerator comprises: (a) a first inner liner defining a first cavity; (b) a second inner liner defining a second cavity; (c) an outer wrapper at least partially surrounding the first inner liner and the second inner liner; (d) a trim breaker coupling the outer wrapper, the first inner liner, and the second inner liner together, the trim breaker comprising (i) a first opening into the first cavity, (ii) a second opening into the second cavity, and (iii) a transition portion extending between the first opening and the second opening, the transition portion comprising a forward portion and a rear portion; and (e) a vacuum insulated panel disposed proximate the rear portion of the of the transition portion.

According to a second aspect of the present disclosure, the cabinet of the first aspect is presented, wherein (i) the vacuum insulated panel comprises a forward side, and (ii) the forward side of the vacuum insulated panel abuts the rear portion of the transition portion of the trim breaker.

According to a third aspect of the present disclosure, the cabinet of any one of the first through second aspects is presented, wherein the vacuum insulated panel is vertically oriented.

According to a fourth aspect of the present disclosure, the cabinet of any one of the first through third aspects is presented, wherein (i) the trim breaker, the outer wrapper, the first inner liner, and the second inner liner together define an insulating cavity that has a reduced pressure compared to atmospheric pressure, and (ii) the vacuum insulated panel is separate from the insulating cavity.

According to a fifth aspect of the present disclosure, the cabinet of the fourth aspect is presented, wherein (i) the first inner liner is disposed above the second inner liner, (ii) the insulating cavity is at least partially defined by a space between a bottom wall of the first inner liner and a top wall of the second inner liner, and (iii) the vacuum insulated panel is disposed elevationally below the space and is separated from the insulating cavity by only the trim breaker.

According to a sixth aspect of the present disclosure, the cabinet of any one of the fourth and fifth aspects is presented, wherein the trim breaker comprises a vertical wall system with a wall having (i) a forward surface positioned to contact a seal of a door to be associated with the cabinet, and (ii) a rear surface at least partially defining the insulating cavity.

According to a seventh aspect of the present disclosure, the cabinet of any one of the first through sixth aspects is presented, wherein the (I) trim breaker further comprises: (a) a vertical wall system contiguous with the first opening, the second opening, and the transition portion between the first opening and the second opening; (b) a first inner wall that extends rearward from the vertical wall system and around the first opening, the first inner wall transitioning to a first inner slot that accepts an edge of the first inner liner to couple the first inner liner and the trim breaker; (c) a second inner wall that extends rearward from the vertical wall system and outside the second opening, the second inner wall transitioning to a second inner slot that accepts an edge of the second inner liner to couple the second inner liner to the trim breaker, wherein the second inner wall includes (i) a portion that runs parallel to the first inner wall and (ii) opposing sections at the transition portion that extend from the second opening toward the portion that runs parallel to the first inner wall; and (d) a receiving portion formed by (i) the opposing sections of the second inner wall, (ii) the portion of the second inner wall that runs parallel to the first inner wall, and (iii) the rear surface of the transition portion; and (II) the vacuum insulated panel is nested within the receiving portion of the trim breaker.

According to an eighth aspect of the present disclosure, the cabinet of the seventh aspect is presented, wherein (i) the first opening of the trim breaker is disposed above the second opening of the trim breaker, (ii) the first inner liner is disposed above the second inner liner, (iii) the first inner wall includes a portion that is disposed horizontally and proximate the transition portion of the trim breaker, (iv) the section of the second inner wall that runs parallel to the first inner wall is parallel to the portion of the first inner wall that is disposed horizontally proximate the transition portion of the trim breaker, and (v) the vacuum insulated panel is disposed under the portion of the second inner wall that runs parallel to the first inner wall and between the sections of the second inner wall that are disposed at the transition portion of the trim breaker.

According to a ninth aspect of the present disclosure, the cabinet of any one of the first through eighth aspects is presented, wherein the transition portion of the trim breaker is positioned to be disposed between a seal of a door and the vacuum insulated panel.

According to a tenth aspect of the present disclosure, the cabinet of any one of the first through ninth aspect is presented, wherein a non-vacuum insulation material is disposed directly rearward of the vacuum insulated panel.

According to an eleventh aspect of the present disclosure, the cabinet of any one of the first through tenth aspects is presented, wherein (i) the vacuum insulated panel is positioned to insulate the second cavity, and (ii) the second cavity bounds a storage compartment that is to be maintained at a temperature less than or equal to 0° C.

According to a twelfth aspect of the present disclosure, the cabinet of any one of the first through eleventh aspects is presented, wherein the outer wrapper comprises an exterior surface that faces toward an external environment.

According to a thirteenth aspect of the present disclosure, the cabinet of any one of the first through twelfth aspects is presented, wherein the trim breaker comprises a vertical wall system comprising a wall with (i) a forward surface positioned to face a seal of a door, and (ii) a recess into the wall positioned and sized to accept a heat loop configured to reduce condensation on the cabinet.

According to a fourteenth aspect of the present disclosure, the cabinet of the thirteenth aspect is presented, wherein the cabinet further comprises a cover attached to the trim breaker that encloses the recess and separates the heat loop from an external environment.

According to a fifteenth aspect of the present disclosure, the cabinet of any one of the first through fifteenth aspects is presented, wherein the trim breaker comprises a plastic.

According to a sixteenth aspect of the present disclosure, a cabinet for a refrigerator comprises: (a) an inner liner defining an inner cavity; (b) an outer wrapper at least partially surrounding the inner liner; (c) a trim breaker coupling the outer wrapper and the inner liner together, the trim breaker comprising an opening into the storage compartment, with the trim breaker, the outer wrapper, and the inner liner together defining an insulating cavity that has a reduced pressure compared to atmospheric pressure; and (d) a vacuum insulated panel within the cavity; wherein, only the trim breaker separates the vacuum insulated panel from the insulating cavity.

According to a seventeenth aspect of the present disclosure, the cabinet of the sixteenth aspect is presented, wherein the transition portion of the trim breaker is positioned to be disposed between a seal of a door and the vacuum insulated panel.

According to an eighteenth aspect of the present disclosure, the cabinet of any one of the sixteenth through seventeenth aspects is presented, wherein the vacuum insulated panel is vertically oriented.

According to a nineteenth aspect of the present disclosure, a cabinet for a refrigerator comprising: (a) a first inner liner defining a first inner cavity; (b) a second inner liner defining a second inner cavity disposed below the first inner cavity; (c) an outer wrapper at least partially surrounding the first inner liner and the second inner liner; (d) a trim breaker coupling the outer wrapper, the first inner liner, and the second inner liner together, the trim breaker defining a first opening into the first inner cavity and a second opening into the second inner cavity; and a vacuum insulated panel disposed within the second cavity, wherein, the trim breaker is shaped and disposed to be rearward of both (i) a seal of a door providing selective access into the first inner cavity and (ii) a seal of a second door providing selective access into the second inner cavity, and wherein, the trim breaker is further disposed to be between the seal of the second door and the vacuum insulation panel.

According to twentieth aspect of the present disclosure, the nineteenth aspect is presented, wherein the vacuum insulated panel is vertically oriented and disposed rearward of, below, and adjacent to the trim breaker.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cabinet for a refrigerator comprising:

a first inner liner defining a first cavity;

a second inner liner defining a second cavity;

an outer wrapper at least partially surrounding the first inner liner and the second inner liner;

a trim breaker coupling the outer wrapper, the first inner liner, and the second inner liner together, the trim breaker comprising (i) a first opening into the first cavity, (ii) a second opening into the second cavity, and (iii) a transition portion extending between the first opening and the second opening, the transition portion comprising a forward portion and a rear portion; and a vacuum insulated panel disposed proximate the rear portion of the transition portion;

wherein, the trim breaker, the outer wrapper, the first inner liner, and the second inner liner together define an insulating cavity that has a reduced pressure compared to atmospheric pressure, and wherein, the vacuum insulated panel is disposed outside of the insulating cavity.

2. The cabinet of claim 1, wherein the vacuum insulated panel comprises a forward side, and the forward side of the vacuum insulated panel abuts the rear portion of the transition portion of the trim breaker.

3. The cabinet of claim 1, wherein the vacuum insulated panel is vertically oriented.

4. The cabinet of claim 1, wherein the vacuum insulated panel includes a liner with a forward side and a rear side that is separated from the forward side by a space to form a cavity within the liner, and the cavity of vacuum insulated panel has an air pressure that is less than atmospheric pressure.

5. The cabinet of claim 1, wherein the first inner liner is disposed above the second inner liner, the insulating cavity is at least partially defined by a space between a bottom wall of the first inner liner and a top wall of the second inner liner, and the vacuum insulated panel is disposed elevationally below the space and separated from the insulating cavity by only the trim breaker.

6. The cabinet of claim 1, wherein the trim breaker comprises a vertical wall system with a wall having (i) a forward surface positioned to contact a seal of a door to be associated with the cabinet, and (ii) a rear surface at least partially defining the insulating cavity.

7. The cabinet of claim 1, wherein the trim breaker further comprises:

a vertical wall system contiguous with the first opening, the second opening, and the transition portion between the first opening and the second opening;

a first inner wall that extends rearward from the vertical wall system and around the first opening, the first inner wall transitioning to a first inner slot that accepts an edge of the first inner liner to couple the first inner liner and the trim breaker;

a second inner wall that extends rearward from the vertical wall system and outside the second opening, the second inner wall transitioning to a second inner slot that accepts an edge of the second inner liner to couple the second inner liner to the trim breaker, wherein the second inner wall includes (i) a portion that runs parallel to the first inner wall and (ii) opposing sections at the transition portion that extend from the second opening toward the portion that runs parallel to the first inner wall; and a receiving portion formed by (i) the opposing sections of the second inner wall, (ii) the portion of the second inner wall that runs parallel to the first inner wall, and (iii) the rear portion of the transition portion; and the vacuum insulated panel is nested within the receiving portion of the trim breaker.

8. The cabinet of claim 7, wherein the first opening of the trim breaker is disposed above the second opening of the trim breaker, the first inner liner is disposed above the second inner liner, the first inner wall includes a portion that is disposed horizontally and proximate the transition portion of the trim breaker, the portion of the second inner wall that runs parallel to the first inner wall is parallel to the portion of the first inner wall that is disposed horizontally proximate the transition portion of the trim breaker, and the vacuum insulated panel is disposed under the portion of the second inner wall that runs parallel to the first inner wall and between the opposing sections of the second inner wall that are disposed at the transition portion of the trim breaker.

9. The cabinet of claim 1, wherein the transition portion of the trim breaker is positioned to be disposed between a seal of a door and the vacuum insulated panel.

10. The cabinet of claim 1 further comprising:

a non-vacuum insulation material disposed directly rearward of the vacuum insulated panel.

11. The cabinet of claim 1, wherein the vacuum insulated panel is positioned to insulate the second cavity, and the second cavity bounds a storage compartment that is to be maintained at a temperature less than or equal to 0° C.

12. The cabinet of claim 1, wherein the outer wrapper comprises an exterior surface that faces toward an external environment.

13. The cabinet of claim 1, wherein the trim breaker comprises a vertical wall system comprising a wall with (i) a forward surface positioned to face a seal of a door, and (ii) a recess into the wall positioned and sized to accept a heat loop configured to reduce condensation on the cabinet.

14. The cabinet of claim 13, wherein the cabinet further comprises a cover attached to the trim breaker that encloses the recess and separates the heat loop from an external environment.

15. The cabinet of claim 1, wherein the trim breaker comprises a plastic.

16. A cabinet for a refrigerator comprising:

a first inner liner defining a first inner cavity, the first inner liner comprising an edge;

a second inner liner defining a second inner cavity disposed below the first inner cavity, the second inner liner comprising an edge;

an outer wrapper at least partially surrounding the first inner liner and the second inner liner;

a trim breaker coupling the outer wrapper, the first inner liner, and the second inner liner together to form an insulating cavity having an air pressure that is lower than atmospheric pressure, the trim breaker defining a first opening into the first cavity and a second opening into the second cavity, and the trim breaker comprising (i) a first inner slot receiving the edge of the first inner liner and (ii) a second inner slot receiving the edge of the second inner liner; and a vacuum insulated panel disposed within the second cavity at least partially under the second inner slot of the trim breaker with the second inner slot disposed between the insulating cavity and the vacuum insulated panel, wherein, the trim breaker is shaped and disposed to be rearward of both (i) a seal of a door providing selective access into the first inner cavity and (ii) a seal of a second door providing selective access into the second inner cavity, and wherein, the trim breaker is further disposed to be between the seal of the second door and the vacuum insulated panel.

17. The cabinet of claim 16, wherein the vacuum insulated panel is vertically oriented and disposed rearward of, below, and adjacent to the trim breaker.

* * * * *